United States Patent [19]

Couderc

[11] 4,137,283

[45] Jan. 30, 1979

[54] STARTING FACILITIES FOR INTERNAL COMBUSTION ENGINE CABURETORS

[75] Inventor: Jean-François Couderc, Bouffemont, France

[73] Assignee: Societe Industrielle de Brevets et d'Etudes, S.I.B.E., Neuilly-sur-Seine, France

[21] Appl. No.: 749,059

[22] Filed: Dec. 9, 1976

Related U.S. Application Data

[63] Continuation of Ser. No. 580,242, May 23, 1975, abandoned.

[30] Foreign Application Priority Data

May 27, 1974 [FR] France ..... 74 18298

[51] Int. Cl.[2] ..... F02M 1/12

[52] U.S. Cl. ..... 261/39 B; 261/52

[58] Field of Search ..... 261/39 B, 52

[56] References Cited

U.S. PATENT DOCUMENTS

| | | | |
|---|---|---|---|
| 2,127,735 | 8/1938 | Hunt | 261/39 B |
| 2,890,032 | 6/1959 | Brown et al. | 261/39 B |
| 2,942,596 | 6/1960 | Carlson | 261/39 B |
| 3,092,999 | 6/1963 | Eickmann et al. | 261/39 B |
| 3,159,692 | 12/1964 | Kittler | 261/39 B |
| 3,171,868 | 3/1965 | Hamilton | 261/39 B |
| 3,190,623 | 6/1965 | Ball | 261/39 B |
| 3,248,096 | 4/1966 | Ball | 261/52 |
| 3,278,171 | 10/1966 | Carlson | 261/50 A |
| 3,279,771 | 10/1966 | Herman et al. | 261/52 |
| 3,606,983 | 9/1971 | Mitchell | 261/39 B |
| 3,813,085 | 5/1974 | Nakada et al. | 261/39 B |

*Primary Examiner*—Tim R. Miles

*Attorney, Agent, or Firm*—Stevens, Davis, Miller & Mosher

[57] ABSTRACT

The pneumatic element which causes partial opening of the choke valve is connected to the intake pipe by a duct having a calibrated restriction. The duct opens into the pipe at a point which is located downstream of the throttle valve under all operating conditions and at another point which is downstream of the throttle when the latter is in the "cold" minimum opening position.

6 Claims, 4 Drawing Figures

STARTING FACILITIES FOR INTERNAL COMBUSTION ENGINE CABURETORS

This is a continuation of application Ser. No. 580,242 filed May 23, 1975 now abandoned.

BACKGROUND OF THE DISCLOSURE

The invention relates to combustion engine carburetors having an automatic choke system or starting system.

There exists starting systems for carburetors having an intake pipe, a main operator-controlled throttle element, a main fuel jet system, a choke valve located upstream of the throttle element and biased towards closure by a thermostat element and biased towards opening by the air flow in said pipe, a pneumatic element constructed to bias said choke valve towards opening, auxiliary means for adjustment of the minimum opening of the main throttle element in dependence upon engine temperature. The pneumatic element communicates via duct means with the downstream side of the main throttle element so that the depression on the downstream side of the main throttle element controls the pneumatic element. The minimum-opening position of the main throttle element can be determined by a fast-idling cam (French Patent Specification No. 1,302,536).

In starting systems of this kind, the underpressure or depression which is operative at the main jet system where the thermostat element is keeping the eccentric flap or valve closed is a means of ensuring a fuel-air mixture of increased richness while the engine starter is being operated. The richness should be decreased without delay once the engine fires, otherwise it will choke and stall. Rapid decrease in richness is produced by opening the eccentric valve to some extent responsive to the depression downstream of the main throttle valve acting on the pneumatic element controlling the choke valve or flap.

There are, however, disadvantages in controlling the opening of the air valve by a pneumatic element since the system has to meet requirements which to some extent are conflicting. The thermostat element which tends to close the air valve produces a closing torque which is higher in proportion as the engine temperature at starting is lower; consequently, the pneumatic element starts to open the air valve only when the depression downstream of the main throttle element exceeds a valve which is higher in proportion as engine temperature is lower, since the opposing torque produced by the thermostat element increases as temperature decreases.

In other words, the engine speed at which the air valve starts to open as engine speed increases is high (strong depression in the inlet tube) at very low starting temperatures (for instance approximately − 20° C) and is low (slight depression in the inlet tube) for higher starting temperatures, for instance of approximately 20° C.

In the latter case, the air valve opens too fast and the engine once started may stall. For overcoming that drawback and ensuring satisfactory operation at starting temperatures of the order of 20° C, the opening movement of the choke or flat may be delayed. Then difficulties arise at low temperatures (− 20° C) due to the air valve opening too slowly and flooding the engine.

SUMMARY OF THE INVENTION

It is an object of the invention to provide an improved carburetor in which the above deficiencies are overcome to a large extent.

According to the invention, the duct means has a calibrated restriction and opens into said intake pipe at a first place which remains downstream of the main throttle element under all operating conditions of the engine and at least at another place which is located upstream of the main throttle element when the latter is in its minimum opening position with the engine hot and downstream of the throttle element when the latter is in its minimum-opening position corresponding to the lowest temperature at which the engine is designed to start.

In other words, the duct means opens into the pipe on both sides of the edge of the throttle element when the same is in its hot-engine minimum-opening position.

The duct means can open into the pipe either by way of a number, at least two, of calibrated orifices disposed along the inlet tube wall or by way of a narrow longitudinal slot extending in the upstream direction from a place which at all engine temperatures remains downstream of the main throttle element.

The invention will be better understood from the following description of carburetors which are exemplary non-limitative embodiments of the invention, reference being made to the accompanying drawings.

DESCRIPTION OF PREFERRED EMBODIMENTS

Figure 1:
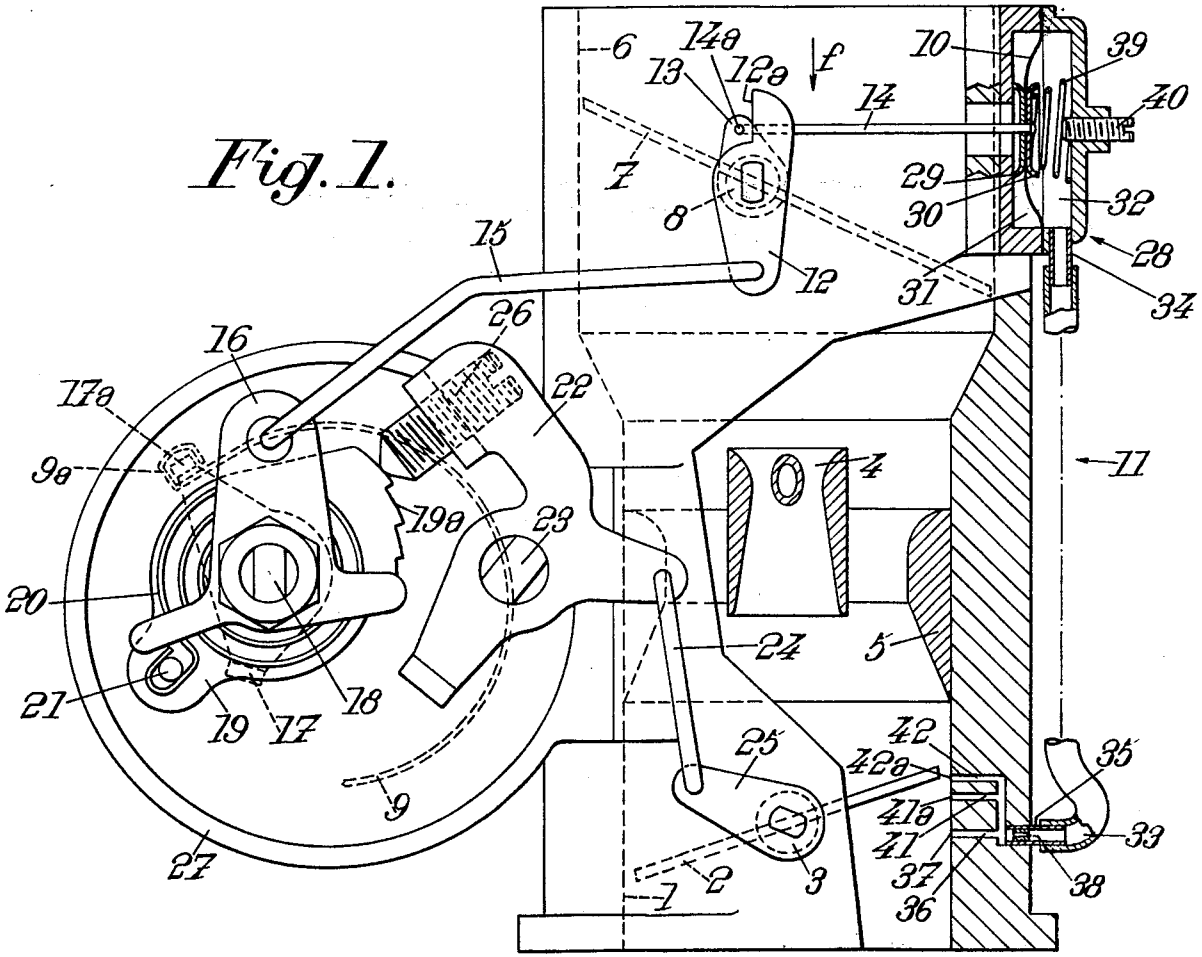
FIG. 1 is a side elevational view in partial section of a downdraught carburetor, the various elements being shown in their relative positions for very cold weather (for instance, at a temperature of − 20° C) before starting of the engine.

Referring to FIG. 1, there is shown 1, carburetor which comprises, disposed in the upstream direction in an intake pipe 1 (the direction of air flow being represented by arrow f), an operator-controlled main throttle element or valve 2, a main jet system 4 for discharging a fuel-air emulsion into a venturi 5 and, in the air intake 6 of pipe 1, an eccentric choke or air valve 7 disposed on a spindle 8 connected to a lever 12. In the embodiment shown the main throttle valve 2 is a butterfly valve disposed on a spindle 3.

Lever 12 is connected by rod 15 to a lever 16; the same is connected to a spindle 18 and to a lever 17 having a finger 17*a* cooperating with the free end 9*a* of a thermostat element, such as a bimetallic coil 9 partly visible in FIG. 1; coil 9 is so adjusted that its free end 9*a* rotates counterclockwise when the coil is heated.

A fast idle cam 19 is so mounted on spindle 18 as to be rotatable thereon and is connected thereto by a thermostat element responsive to the ambient temperature. In the embodiment shown the latter thermostat element is a bimetallic coil 20 having its inside end secured to spindle 18, its outside end cooperating with a finger 21 of cam 19. The same has camming surfaces 19*a* in bearing engagement with a screw 26 rigidly secured to a lever 22 movable around a stationary spindle 23. Lever 22 is connected by a rod 24 to a lever 25 secured to valve 2 so that engagement between screw 26 and a camming surface 19*a* determines the minimum-opening position of main throttle valve 2.

Bimetallic coil 9 is received in a casing 27 secured to the carburetor casing and is heated to a temperature representative of engine temperature by conventional heating means (not shown) such as an air flow which has passed close to the engine exhaust manifold or by a flow of engine coolant or by electrical means.

Lever 12 also has a one-way connection with a rod 14. To this end, lever 12 has a step 12*a* for bearing engagement with end 14*a* of rod 14; end 14*a* is bent at a right-angle to rod 14 and is maintained at a constant distance from spindle 8 by a lever 13 freely rotatable on spindle 8. At its other end, rod 14 is connected to a disphragm 10 of a capsule 28. Diaphragm 10 is clamped between two cups 29 and 30 and divides capsule 28 into two chambers 31, 32. Chamber 31 experiences the pressure at air intake 6 and chamber 32 communicates with pipe 1 downstream of main throttle valve 2 by a connection 11 in the form of a flexible pipe 33 secured at one end to a spigot 34 of capsule 28 and at its other end to a spigot 35 of a passage 36 which extends into inlet tube 1 at a place 37. In the system 11 there is a calibrated orifice 38 in spigot 35.

Capsule 28 also has a spring 39 which opposes the force arising from the pressure difference acting on the diaphragm 10; capsule 28 also has a screw 40 abuttable by rod 14 and serving as a means to adjust the opening of the valve 7 produced by the depression downstream of the main throttle valve 2.

The capsule 28 controlling partial opening of the air valve 7, as well as communicating via passage 36 with inlet tube 1 at a place which always remains downstream of the main throttle valve 2, is also connected to the pipe 1 at at least one place which changes over from the upstream to the downstream side of valve 2 when the same changes from its hot-engine minimum-opening position (at and above 80° C for instance) to its minimum-opening position corresponding to starting at a low temperature of e.g. approximately − 20° C. Accordingly, further calibrated passages, as 41 and 42 — there being two such further passages in the embodiment shown in FIGS. 1 and 3 — extend into pipe 1 by way of orifices 41*a*, 42*a* distributed along a generatrix of the inlet tube wall upstream of valve 2 when the same is in its hot-engine minimum-opening position.

Figure 3:
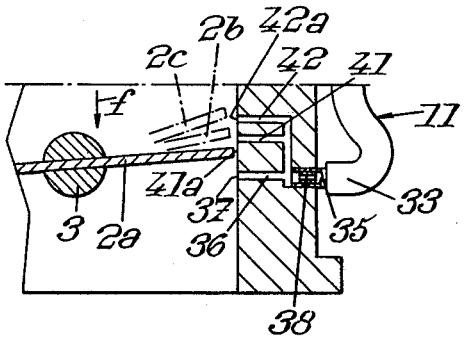
FIG. 3 is a detail view showing a plurality of minimum-opening positions of the throttle element or valve at different temperatures, from the highest temperature (shown in solid lines) to the lowest temperature.

As can be seen in FIG. 3, passage 41 extends into the inlet tube 1 upstream of the edge of valve 2 when the same is in its hot-idle minimum-opening position 2*a* — i.e., when screw 26 is in abutting engagement with the lowest camming surface or step of the fast idle cam 19 — but is downstream of the main throttle valve 2 when the same is in position 2*b* and 2*c* which are defined by the steps or camming surfaces 19*a* of the accelerated-idle cam 19 and which correspond to engine temperatures below a particular value. Passage 42 extends into pipe 1 upstream of the main throttle valve 2 when the same is in position 2*a* or 2*b* and downstream of valve 2 when the same is in position 2*c*. Operation is therefore as follows:

At very low engine temperatures of e.g. − 20° C, the throttle valve 2 is before starting in the minimum-opening position 2*c* of FIG. 3. All the orifices 37, 41*a*, 42*a* are downstream of the edge of valve 2. Immediately, the engine starts to turn, the depression downstream of valve 2 is fully operative via the calibrated orifice 38 in capsule chamber 32. If the dimensions of orifice 38 and the calibration of spring 39 are appropriate, the opening movement of air valve 7 as the depression in the pipe 1 and the engine speed increase is approximately gradual and maintains a mixture of appropriate richness in the transient phase following starting.

At higher engine temperatures, e.g. + 20° C, the valve 2 is immediately before starting in position 2*b* in FIG. 3, and so orifice 42*a* is upstream of the edge valve 2 but orifices 41*a* and 37 are downstream. Also, the closing torque arising from the coil 9 of air valve 7 is definitely less than at starting temperatures of the order of − 20° C.

Immediately, the engine starts and is self-operating, only a fraction of the pipe depression reaches the capsule chamber 32 and acts on diaphragm 10. The fraction can be determined by an appropriate selection of the cross-sectional area of passage 42. Also the depression builds up gradually in chamber 32 because of the presence of the orifice 38. The speed of air valve opening movement in dependence upon increasing engine speed can therefore be so devised that richness remains satisfactory for such starting conditions.

Figure 2:
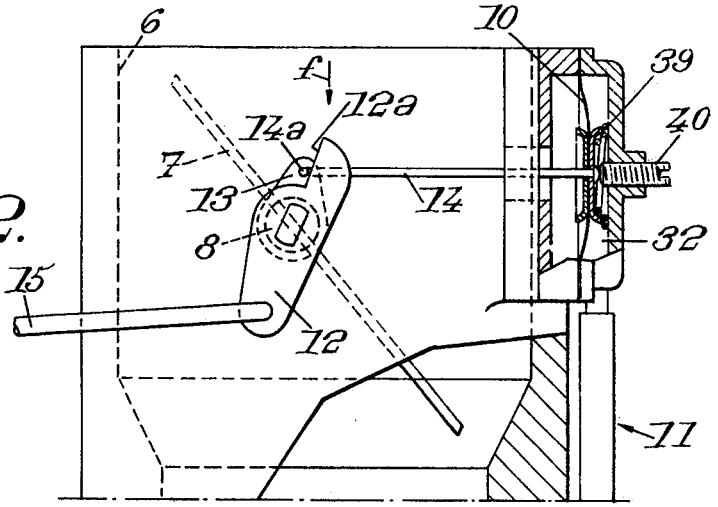
FIG. 2 is a detail view showing the pneumatic system for opening the air valve of the carburetor of FIG. 1, the elements being shown in their relative positions with a partial opening of the air valve once the engine has started to turn.

If, however, the full depression operative downstream of the main throttle valve 2 had been applied immediately to diaphragm 10, the opening movement of the air valve 7 from its position in FIG. 1 to its position in FIG. 2 would have been too fast, with the consequent risk of the engine stalling immediately after starting due to excessive leaning of the fuel-air mixture supplied to the engine.

In the embodiment shown in FIGS. 1 and 3, two passages 41, 42 are provided whose position relative to the edge of the main throttle valve changes in dependence upon temperature; however, more than two passages can be provided. More particularly, an extra passage can be provided which, when the main throttle valve is in its minimum-opening position, opens into the intake pipe upstream of the main throttle valve at all temperatures. Also, the number of further passages is not limited to two or three, although as a rule two or three will be adequate.

Figure 4:
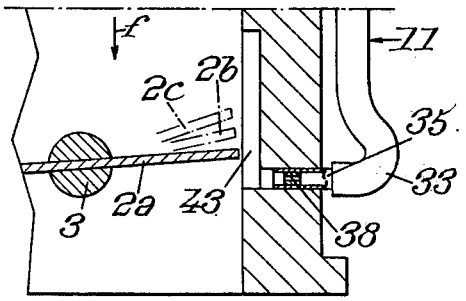
FIG. 4 which is similar to FIG. 3, shows a modified embodiment of the invention, the throttle valve being shown in the same minimum-opening positions.

Instead of using a number of separate passages as in FIGS. 1, 2 and 3, passage 11 can communicate with inlet tube 1 via a narrow slot 43, as shown in FIG. 4. As can be seen therein, slot 43 extends from a position which always remains downstream of the edge of the throttle valve 2 as far as a position which is upstream of the edge of the throttle valve when the same is in its widest minimum-opening position determined by cam 19, although this feature is not essential.

The invention therefore obviates the disadvantages of the prior art systems by means of very simple alterations which are in fact limited to an adaptation of the means connecting the capsule 28 and the pipe 1.

I claim:

1. A carburetor for an internal combustion engine, said carburetor comprising:

an intake pipe;

a main operator-controlled throttle element in said intake pipe;

a main fuel jet system;

a choke valve in said intake pipe upstream of said throttle element, said choke valve being biased toward opening by air flow in said intake pipe;

a thermostat element comprising a bimetallic coil subjected to the temperature of the engine;

a rotary lever;

a one-way connection linkage;

one end of said bimetallic coil being fixed and the other end thereof being connected to said choke valve through said rotary lever and said one-way connection linkage;

a pneumatic element having a one-way connection with said choke valve, said pneumatic element being constructed to override said thermostat element when energized to open said choke valve by a predetermined amount;

auxiliary means comprising a spindle means secured to said lever;

a fast idle cam rotatably mounted on said spindle means;

a separate thermostatic means subjected to ambient temperature and connecting said cam and said spindle means;

said thermostat element and auxiliary means being constructed to move said fast idle cam to a position corresponding to a first minimum opening position when the temperature of the engine increases and the ambient temperature increases and for moving the fast idle cam to a position corresponding to a second minimum opening position of said main throttle element, in which the main throttle element is more open than in said first position, when the engine temperature and ambient temperature are at the value corresponding to the minimum starting temperature of the engine; and duct means fluidly communicating said pneumatic element and said intake pipe, said duct means having a calibrated restriction therein, said duct means opening into said intake pipe at a first fixed position which is downstream of the main throttle element during all operating conditions of the engine, and a second fixed position which is upstream of the main throttle valve when it is in said first minimum opening position and is downstream of the main throttle valve when it is in said second minimum opening position.

2. A carburetor according to claim 1 wherein the duct means opens into the intake pipe at positions disposed on both sides of the main throttle element when the same is in its hot-engine minimum-opening position.

3. A carburetor according to claim 1, wherein the duct means opens into the intake pipe through a number of calibrated orifices disposed along the wall of the intake pipe.

4. A carburetor according to claim 1, wherein the duct means opens into the intake pipe via a narrow longitudinal slot extending in the upstream direction from a place which at all engine temperatures is downstream of the main throttle element.

5. A carburetor according to claim 1, wherein the first hot temperature is approximately 80° C.

6. A carburetor according to claim 1, wherein the auxiliary means is also sensitive to the ambient temperature.

* * * * *